US007758917B2

(12) United States Patent
Gentsch et al.

(10) Patent No.: US 7,758,917 B2
(45) Date of Patent: Jul. 20, 2010

(54) METHOD OF PRODUCING AN ARC-EROSION RESISTANT COATING AND CORRESPONDING SHIELD FOR VACUUM INTERRUPTER CHAMBERS

(75) Inventors: Dietmar Gentsch, Ratingen (DE); Georg Ptaschek, Limeshain (DE)

(73) Assignee: ABB Technology AG, Zurich (CH)

( * ) Notice: Subject to any disclaimer, the term of this patent is extended or adjusted under 35 U.S.C. 154(b) by 540 days.

(21) Appl. No.: 11/663,438

(22) PCT Filed: Sep. 23, 2005

(86) PCT No.: PCT/EP2005/010323

§ 371 (c)(1), (2), (4) Date: Mar. 21, 2007

(87) PCT Pub. No.: WO2006/032522

PCT Pub. Date: Mar. 30, 2006

(65) Prior Publication Data

US 2007/0196570 A1 Aug. 23, 2007

(30) Foreign Application Priority Data

Sep. 25, 2004 (DE) ..... 10 2004 046 641

(51) Int. Cl.
*B05D 1/12* (2006.01)
*C23C 1/12* (2006.01)

(52) U.S. Cl. ..... 427/191; 427/192; 427/201; 427/427

(58) Field of Classification Search ..... 427/191, 427/192, 201
See application file for complete search history.

(56) References Cited

U.S. PATENT DOCUMENTS

| | | | | |
|---|---|---|---|---|
| 5,302,414 | A * | 4/1994 | Alkhimov et al. | 427/192 |
| 6,574,864 | B1 | 6/2003 | Meissner et al. | |
| 2003/0209286 | A1 * | 11/2003 | Leonardi et al. | 148/104 |

FOREIGN PATENT DOCUMENTS

| | | | |
|---|---|---|---|
| DE | 196 32 573 | A1 | 2/1998 |
| DE | 197 14 654 | A1 | 10/1998 |
| DE | 197 47 242 | A1 | 4/1999 |
| EP | 911 425 | A1 | 4/1999 |
| WO | 2005/078755 | A1 | 8/2005 |

OTHER PUBLICATIONS

International Search Report for PCT/EP2005/010323 dated Dec. 12, 2005.

* cited by examiner

*Primary Examiner*—Frederick J Parker
(74) *Attorney, Agent, or Firm*—Buchanan Ingersoll & Rooney PC

(57) ABSTRACT

A method for producing an arc-erosion resistant coating provides a substrate material with an arc-erosion resistant layer by a cold-gas spraying method. The method can be used for producing an arc-erosion resistant coating in inner regions of vacuum interrupter chambers that are exposed to electric arcs. An exemplary vacuum interrupter chamber with a shield coated inside is disclosed for medium-voltage switchgear.

20 Claims, 1 Drawing Sheet

METHOD OF PRODUCING AN ARC-EROSION RESISTANT COATING AND CORRESPONDING SHIELD FOR VACUUM INTERRUPTER CHAMBERS

BACKGROUND OF THE INVENTION

1. Field of the Invention

The invention relates to a method for producing an arc-erosion resistant coating, in particular for inner regions of shields that are exposed to electric arcs, and to a shield produced in this way for vacuum interrupter chambers.

In particular in inner regions of switching devices that are exposed to electric arcs, for example so-called vacuum interrupter chambers, arranged inside which are contact pieces which pull apart the closed switching contacts in a permanent vacuum by means of a mechanism acting from the outside, possibly on the basis of an appropriate displacement-time curve, internal components undergo strong thermal and plasma-related stress.

2. Description of Related Art

Such vacuum interrupter chambers are used in low-voltage, medium-voltage and high-voltage switchgear. Electric arcs that are created between contact pieces in a vacuum atmosphere, in particular under short-circuit current conditions during switching off (separation of the contact pieces), are extinguished the next time the current passes through zero, or at the latest the next-but-one time it passes through zero. However, they act on the inner regions of the vacuum interrupter chamber only for milliseconds and, as is known, high energy densities thereby occur, even if only for a brief time. This means that there is quite a significant load on at least some of the components of a vacuum interrupter chamber in the case of a compact design of a vacuum chamber, and so the service life of such a vacuum chamber is substantially limited by the number of switching operations that are performed in the case of a short-circuit.

For this reason, some of the vacuum interrupter chambers are equipped with an arc-erosion resistant shield, which is positioned between the surrounding area of the contact pieces and the inner wall of the interrupter chamber (for example the ceramic insulator).

Since the shields are thin-walled, cylindrical, partly contoured, sheet-metal parts, their plasma erosion is particularly high under the heat correspondingly produced.

Furthermore, sintering methods for producing copper-chromium shields by means of a powder sintering process are known from the prior art. For this purpose, pressing tools for producing the green compacts are required for the different diameters. The production of a compact material subsequently takes place by sintering the green compacts at temperatures of around 1000 degrees Celsius under a vacuum or an inert-gas atmosphere.

Furthermore, the plasma spraying method is known as an example of a thermal spraying method. The thermal method is used for applying a copper-chromium layer. Plasma spraying is carried out in a known way on the basis of the strong getter effect of the chromium in an inert-gas atmosphere. An increased gas content in the sprayed-on layer is unavoidable however, and is disadvantageous.

Furthermore, so-called MLC methods are known, used for producing a sheet form for vacuum interrupter chamber shields or vacuum interrupter chambers, according to DE 19747242 C2.

The use of a copper-chromium shield provides a broader scope for the structural design of a compact vacuum interrupter chamber. However, this entails higher costs of the vacuum interrupter chamber. This disadvantage can be partly reduced by integration of the shield and arc-erosion resistant layer. Nevertheless, the arc-erosion resistance is limited and at the same time the methods referred to are relatively complex. Moreover, certain material compositions, that is to say the variation of the stoichiometric element, are also much more difficult here.

SUMMARY

The invention is therefore based on the object of providing a method for producing arc-erosion resistant shields which on the one hand can be produced more easily, but on the other hand have an extremely high arc-erosion resistance.

With regard to the use of a vacuum interrupter chamber, the set object is achieved by such an arc-erosion resistant shield made by an exemplary method being used inside said chamber.

The essential aspect here of the production method according to the invention is that a substrate material is coated with an arc-erosion resistant alloy and/or a composite material by the cold-gas spraying method. It has been found here that an extremely arc-erosion resistant layer can be used on a substrate or on shields, including for use in applications with high erosive and thermal loading, such as in vacuum interrupter chambers, by the cold-gas spraying method, which is easy to accomplish.

The starting powder mixture of copper and chromium is then used in the known cold-gas spraying method in such a way that shields for the inner coating of substrates or shields in vacuum interrupter chambers are thereby coated at least in the regions that are exposed to plasma and thermal erosion. The chromium concentration can be set over a wide range for this purpose, which allows said process technique of cold-gas spraying. The shield, which may a priori be formed with thin walls, is preferably coated with a layer of >0-2 mm. This produces a very dense layer with a low gas content. The layer may in this case be sprayed onto the component under an air or inert-gas atmosphere. In the case of thermal spraying, the gas content of the finished layer is much higher due to the strong getter effect of the chromium. This clearly sets the cold-gas spraying method apart from the known plasma or flame spraying.

This applies both to gases which chemically react with the two powders and to gas incorporated in the layer, so-called included gas. The latter can be easily removed from the layer during a heat treatment (soldering) of a vacuum interrupter chamber under a vacuum atmosphere by desorption.

In a further advantageous refinement, it is specified that, in the case of the copper-chromium mixture used, the chromium component can be adjusted between 0 and 100 percent by weight.

Such a possibility only exists in this simple way with the aid of the specified technology used here.

In a further advantageous refinement, it is specified that the powder has a grain size of between approximately 0 and 150 micrometers. In this range, optimum results are achieved.

In a further advantageous refinement, it is specified that, apart from copper, materials such as tungsten, molybdenum, platinum, zirconium, yttrium or palladium can also be used.

In a further advantageous refinement, it is specified that, after coating, the layer produced in this way can be reduced under hydrogen or degassed by annealing under a high-vacuum atmosphere.

DETAILED DESCRIPTION

Figure 1:
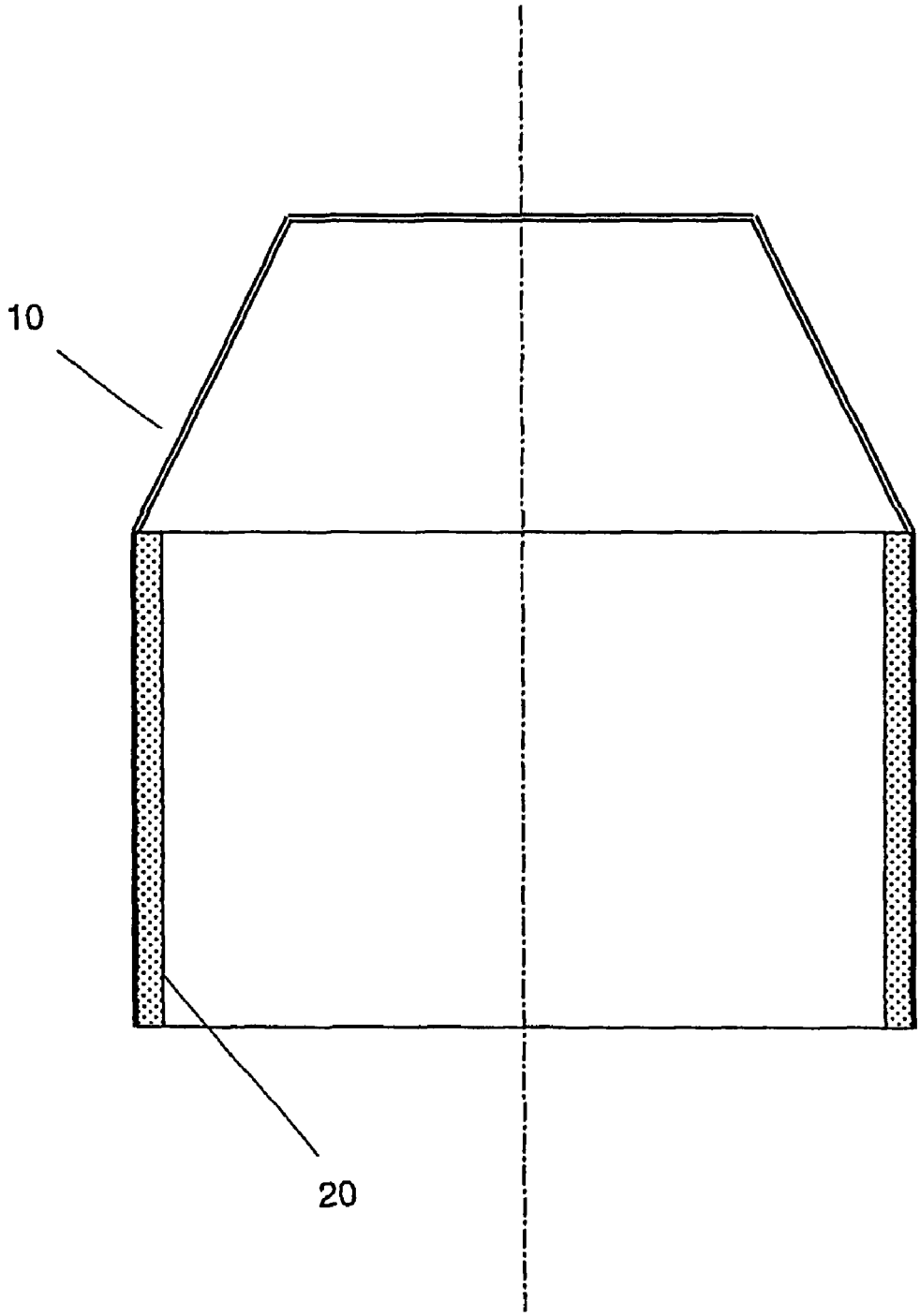
FIG. 1 is a schematic view of an exemplary embodiment of the invention.

In an exemplary embodiment according to FIG. 1, a section through the vacuum interrupter chamber is represented. At the height of the two contact pieces and also with allowance for the switching stroke (displacement), the arc-erosion resistant shield 10 is therefore arranged in this region inside the vacuum interrupter chamber. The shield is in this case designed like a tapering piece of tube, which is to be positioned at the appropriate location inside the vacuum interrupter chamber. In this exemplary embodiment, only a partial region of the tube portion (the shield) is coated with an arc-erosion resistant coating 20 on the inner face or the inner surface of the shield 10, in the region that is subjected to thermal loading by the arc plasma. The shield 10 may in this case be produced both from materials such as high-grade steel and from copper. What is important is the property of the coating that provides the arc-erosion resistance.

However, with the use according to the invention of the cold-gas spraying method for components of this type, it is also conceivable that other metallic or even ceramic materials may be coated with an arc-erosion resistant layer.

The invention claimed is:

1. A method for producing an arc-erosion resistant coating, comprising providing a substrate material with an arc-erosion resistant layer by a cold-gas spraying method wherein the arc-erosion resistant coating is reduced under hydrogen.

2. The method as claimed in claim 1, wherein the arc-erosion resistant layer comprises an alloy of copper and chromium and/or a composite material with a variable chromium component between theoretically 0 and 100 percent by weight.

3. The method as claimed in claim 2, wherein a stoichiometric component of this alloy has a variable chromium component between theoretically 0 and 100 percent by weight.

4. The method as claimed in claim 1, wherein the coating material used to start with in this method is in the form of a powder with a grain size of greater than 0 and less than 150 micrometers.

5. The method as claimed in claim 2, wherein, apart from copper and chromium, tungsten, or molybdenum, or platinum, or zirconium, or yttrium, or palladium along with copper or a mixture of these elements are also used.

6. The method as claimed in claim 1, wherein the coating is applied to a ceramic substrate material.

7. The method as claimed in claim 1, wherein already alloyed powder starting materials or mixtures are also used.

8. A vacuum interrupter chamber with a shield coated as claimed in claim 1 arranged inside it and used for medium-voltage switchgear.

9. The method as claimed in claim 1 for producing an arc-erosion resistant coating in inner regions of vacuum interrupter chambers that are exposed to electric arcs.

10. The method as claimed in claim 1, wherein the arc-erosion resistant coating is degassed by annealing under a high-vacuum atmosphere.

11. A vacuum interrupter chamber with a shield coated as claimed in claim 5 arranged inside it and used for medium-voltage switchgear.

12. A method for producing an arc-erosion resistant coating, comprising providing a substrate material with an arc-erosion resistant layer by a cold-gas spraying method wherein the arc-erosion resistant coating is degassed by annealing under a high-vacuum atmosphere.

13. The method as claimed in claim 12, wherein the arc-erosion resistant layer comprises an alloy of copper and chromium and/or a composite material with a variable chromium component between theoretically 0 and 100 percent by weight.

14. The method as claimed in claim 13, wherein a stoichiometric component of this alloy has a variable chromium component between theoretically 0 and 100 percent by weight.

15. The method as claimed in claim 12, wherein the coating material used to start with in this method is in the form of a powder with a grain size of greater than 0 and less than 150 micrometers.

16. The method as claimed in claim 13, wherein, apart from copper and chromium, tungsten, or molybdenum, or platinum, or zirconium, or yttrium, or palladium along with copper or a mixture of these elements are also used.

17. The method as claimed in claim 12, wherein the coating is applied to a ceramic substrate material.

18. The method as claimed in claim 12, wherein already alloyed powder starting materials or mixtures are also used.

19. A vacuum interrupter chamber with a shield coated as claimed in claim 12 arranged inside it and used for medium-voltage switchgear.

20. The method as claimed in claim 12 for producing an arc-erosion resistant coating in inner regions of vacuum interrupter chambers that are exposed to electric arcs.

* * * * *